United States Patent [19]

Feliks

[11] 4,235,265

[45] Nov. 25, 1980

[54] ASEPTIC CONTAINER FILLER APPARATUS

[75] Inventor: James J. Feliks, Doraville, Ga.

[73] Assignee: The Mead Corporation, Dayton, Ohio

[21] Appl. No.: 17,614

[22] Filed: Mar. 5, 1979

[51] Int. Cl.[3] ..... B65B 3/12; B65B 31/02

[52] U.S. Cl. ..... 141/85; 53/86; 92/98 D; 92/168; 141/51; 141/264; 141/284; 141/392; 222/380

[58] Field of Search ..... 53/86; 74/18.1; 92/168, 92/98 D; 141/47, 51, 85, 143–147, 152, 198, 263, 264, 284, 286, 374, 392; 222/380, 152, 383

[56] References Cited

U.S. PATENT DOCUMENTS

| | | | |
|---|---|---|---|
| 3,005,473 | 10/1961 | Ring | 141/264 X |
| 3,760,853 | 9/1973 | Trusselle | 141/146 |
| 3,804,135 | 4/1974 | Waxlax | 141/146 X |
| 4,051,878 | 10/1977 | Ohmeis et al. | 141/152 X |
| 4,099,549 | 7/1978 | Belysher et al. | 141/392 X |

*Primary Examiner*—Frederick R. Schmidt
*Attorney, Agent, or Firm*—Rodgers & Rodgers

[57] ABSTRACT

A mechanism and method for filling containers within a sterile chamber under aseptic conditions includes a vertically disposed nozzle (48) which forms an extension of the sterile chamber and which is arranged to have its lower outlet end inserted into an open container to be filled and which is provided with valve closure element (51) which is opened when the nozzle is at its lowermost position and which remains open during filling of the container which is accompanied by upward movement of the nozzle and of the closure element while maintained in open position so as to prevent splashing together with a drip proof seal (49, 52, and 53) for preventing dripping following closure of the valve means. A measuring cylinder (10) and associated piston (9) are mechanically interrelated with the nozzle so that charging movement of the piston forces a measured quantity of flowable material into the nozzle for discharge therefrom while the nozzle is moved upwardly and once the upward movement of the nozzle is completed upward movement of the measuring piston commences followed by independently controlled downward movement of the nozzle and opening of the nozzle closure means. According to one feature of the invention the flowable material is isolated from atmosphere by suitable barrier cavities containing sterile inert gas under slight pressure above atmospheric pressure and defined in part by rolling seals which isolate the moving elements from atmoshpere.

23 Claims, 6 Drawing Figures

60
48a
50a
50
54
53
49
52
51
42
36
90
36
69
82a
85
86
79a
2
83
82
37
37
81
84
78
79
95
80
70
95a
67a
45a
96
97
97a
91
35
67b
67
8
34
68
99
55
100
45
66
56
72
71
73
65
55b
76
57
58
101
47
47
75
46
3
48
55a
60
61
49
53
59
59
C
52
54
50
51

ASEPTIC CONTAINER FILLER APPARATUS

TECHNICAL FIELD

This invention relates to aseptic filling of containers used to package flowable material such as orange juice, apple juice, applesauce and the like. Such containers ordinarily are formed in a cuplike configuration of plastic, paperboard, metal, glass or other material and are closed in a sealed condition by a suitable lid.

BACKGROUND ART

Known container filler mechanism include nozzle means which is disposed above a container to be filled so that flow of material into the container frequently is accompanied by undesirable splashing and spraying or misting and closure means for such nozzles is sometimes not entirely effective and permits dripping of the flowable material following the completion of a container filling operation. Such splashing and dripping is highly undesirable because it affects the accuracy of fill and also interferes with the sealing of the container by a sealing lid and may result in a defective seal which leads to contamination of the contents of the container. Known arrangements include reciprocating mechanisms in which a piston rod is exposed to atmosphere during some portion of the cycle with obvious potential for contamination. Other known devices simply utilize a continuous flow of product which introduce product directly to the container and which may thus interefere with sealing. Other known arrangements utilize a nozzle which is lowered into a container to be filled and is raised during filling to minimize splashing. It is also known to raise the container during filling to prevent splashing. Copending U.S. Patent Application Ser. No. 929,512 filed July 31, 1978 and owned by the assignee of this application discloses a sealing mechanism for applying a cover to a container in an aseptic environment which is isolated from atmosphere.

DISCLOSURE OF INVENTION

According to this invention in one broad aspect, sterile flowable material in a sterile reservoir under sterile inert gas pressure is supplied through check valve means into a static measuring cylinder which is isolated from atmosphere by a rolling seal between the interior of the cylinder and a part of the movable piston therein and inert gas at a pressure above atmospheric pressure is supplied to the interior of the measuring cylinder between the rolling seal and the piston. Discharge of flowable material is effected from the measuring cylinder to a transfer cavity defined by an outer fixed housing and an inner movable nozzle. A rolling seal forms a fluid tight junction between the housing and nozzle. In order to prevent contaminant from atmosphere from entering the transfer cavity, sterile inert gas under slight pressure above atmospheric pressure is supplied to the transfer cavity which is in communication with the interior of the nozzle. An operating rod is reciprocable within the nozzle and controls a nozzle valve. A diaphragm seal is interconnected between the operating rod exterior and the interior of the nozzle so that sterile inert gas under pressure in the transfer cavity is sealed against atmosphere and the interior of the nozzle is maintained under aseptic conditions whereby flowable material may be dispensed from the nozzle into a container to be filled which itself is disposed in an aseptic environment as disclosed in Copending U.S. Appln. Ser. No. 929,512.

Means are provided for elevating the nozzle after the nozzle is opened during a filling operation thereby to inhibit any tendency to splash and the undesirable results of splashing. In order to prevent dripping following a filling operating and closure of the nozzle valve, the nozzle is constructed so that the inner surface of its lower end is outwardly bevelled and the closure member at its upper part is of cone shaped configuration complimentary to the outwardly bevelled part of the nozzle. The lower part of the closure element is provided with a groove in which a suitable sealing element of resilient material such as an O-ring is mounted thereby to provide means for preventing leakage following engagement of the O-ring with the inner outwardly bevelled surface of the lower end of the nozzle. The area below the O-ring groove is straight sided and is inside the tapered seat thereby leaving an annular cavity or annular opening to restrain drops of liquid by capillary action.

The nozzle is supplied with a charge of material to be dispensed into the container by means including a transfer cavity disposed about a part of the nozzle together with a measuring cylinder arranged to communicate with the transfer cavity and provided with a measuring piston coupled mechanically with the nozzle so that during a nozzle charging operation by the measuring cylinder, the nozzle is mechanically moved upwardly until its lower end occupies a position slightly above the container to be filled. During a container filling operation the measuring piston moves upwardly to a cylinder charged position. During this operation the nozzle itself is uncoupled mechanically from the measuring cylinder and is arranged to move downwardly. The nozzle is free to occupy a lowermost position at the beginning of a filling operation at which time the nozzle valve is opened. The filling operation as explained is accompanied by upward splash free movement of the nozzle to its uppermost position which is mechanically linked to the measuring piston.

BRIEF DESCRIPTION OF THE DRAWINGS

In the drawings

and in which.

BEST MODE FOR CARRYING OUT THE INVENTION

Figure 1:
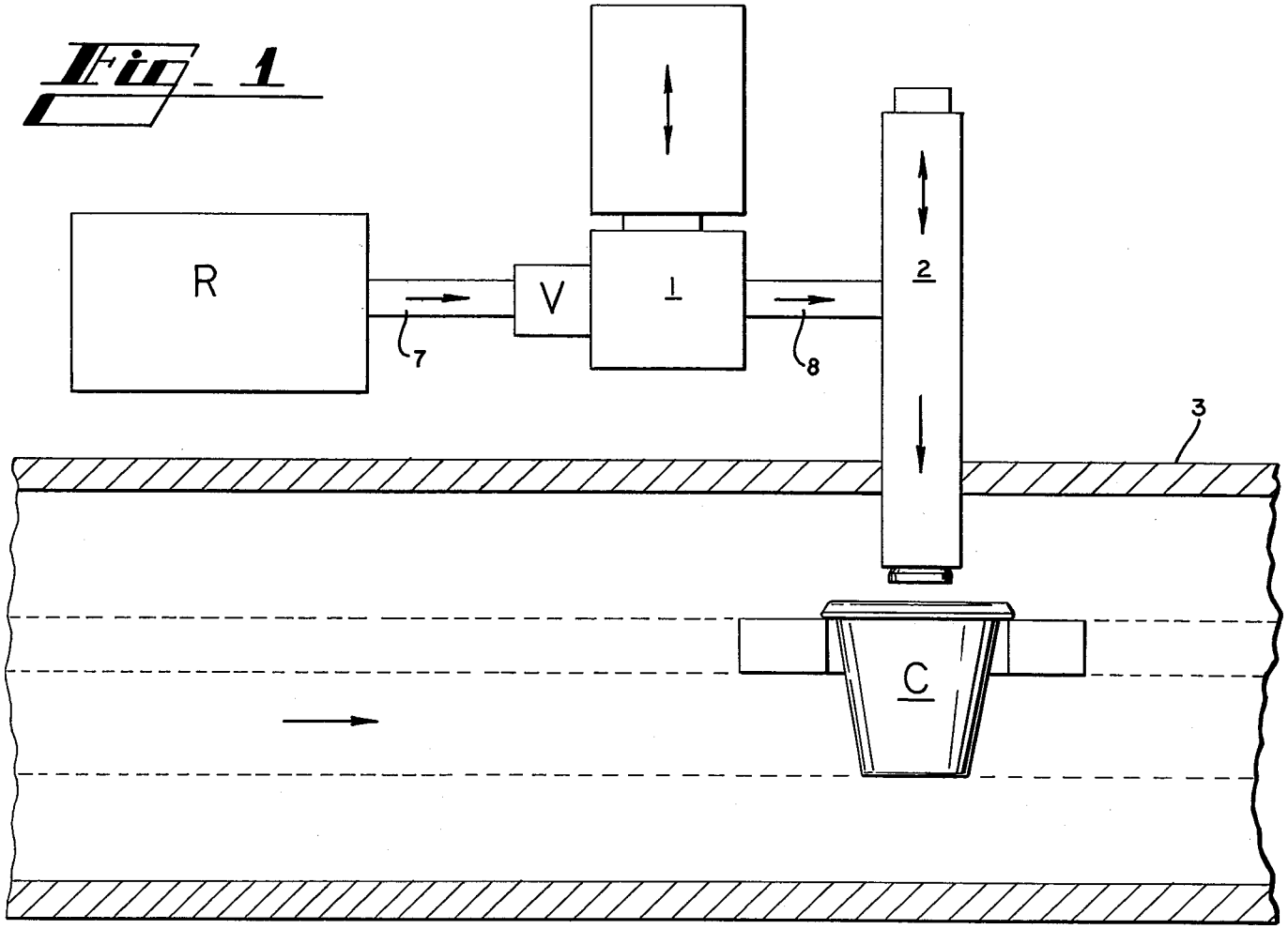
FIG. 1 is an overall block diagram which represents the major components of the invention.

In the drawings the schematic arrangement of FIG. 1 includes a reservoir R the interior of which is isolated from atmosphere and in which flowable material is contained as well as sterile inert gas under pressure. A conduit 7 and a check valve V interconnect reservoir R and measuring cylinder 1 the interior of which is isolated from atmosphere and which contains sterile inert gas under pressure. Conduit 8 interconnects the interior of nozzle housing 2 and the interior of measuring cylinder 1 which is isolated from atmosphere and which is maintained under pressure of sterile inert gas so that flowable material may be supplied under aseptic conditions from reservoir R to cup C which itself is disposed in enclosure 3 in an aseptic environment of a sterile inert gas under slight pressure.

Figure 2A:
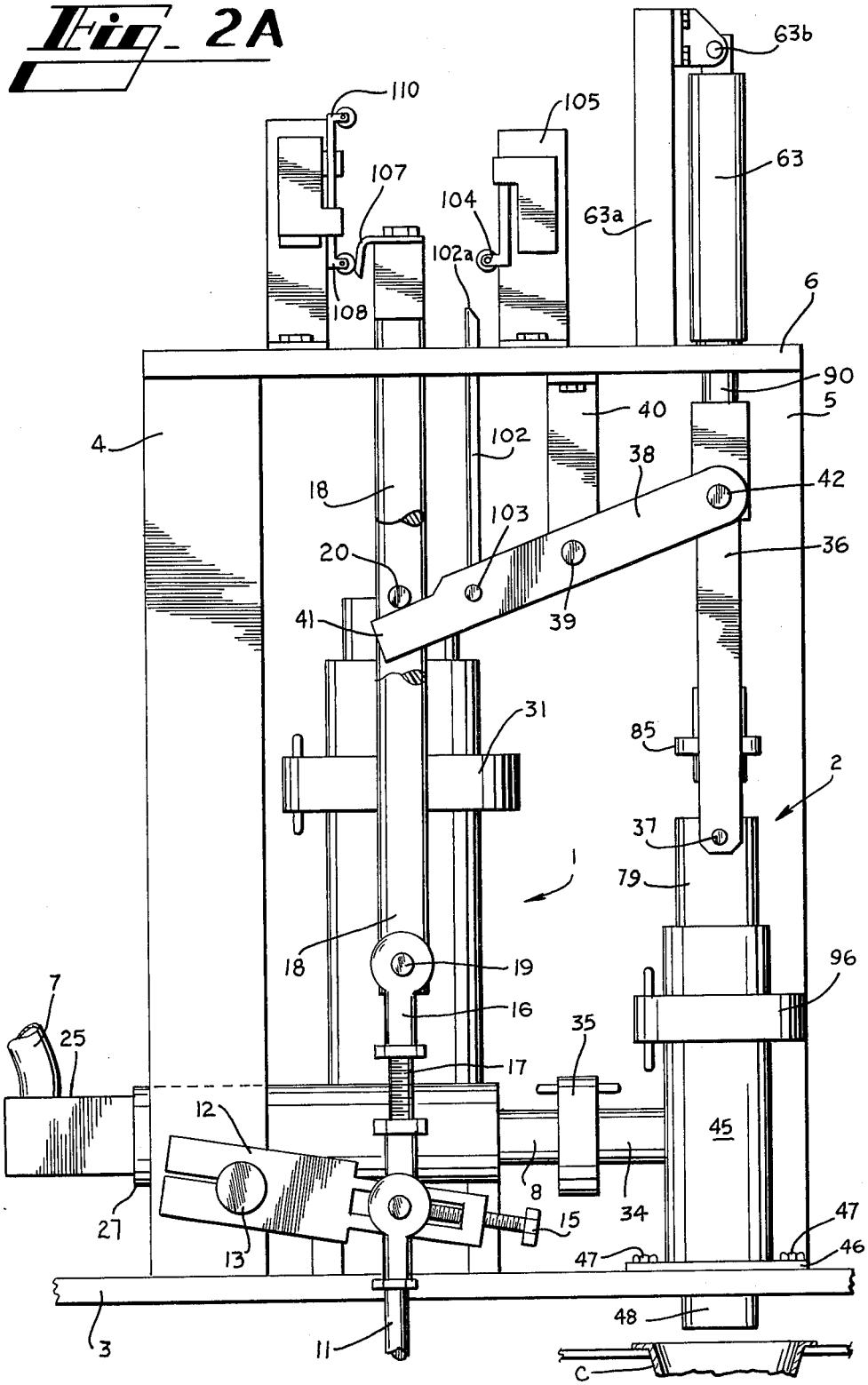
FIG. 2A is a side view of a mechanism constructed according to the invention and which represents the nozzle in its uppermost position and the measuring piston in its lowermost position upon completion of a nozzle charging operation.
Figure 2B:
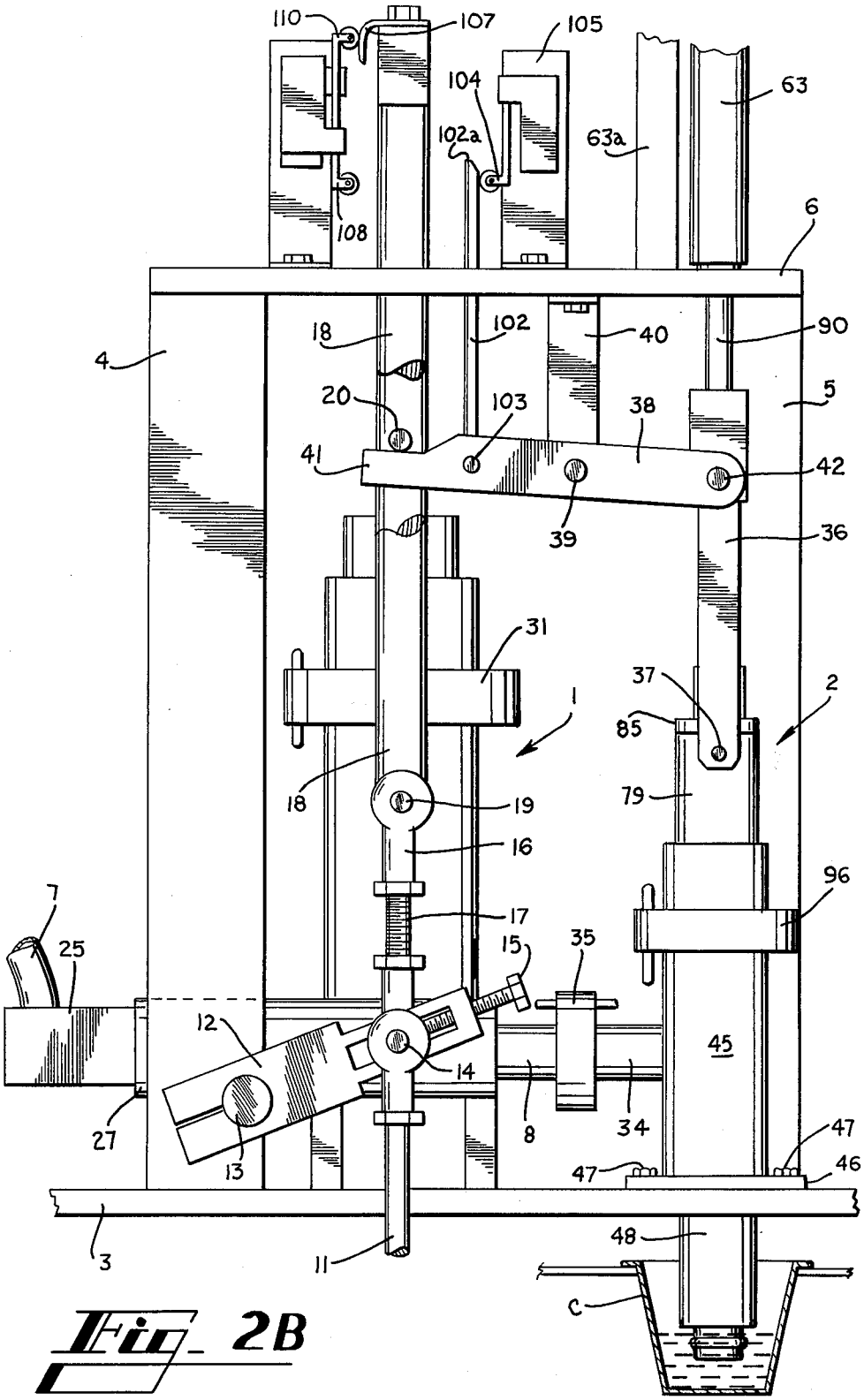
FIG. 2B is a view similar to FIG. 2A but which shows the parts in the positions which they occupy with the nozzle in its lowermost position at or shortly after the beginning of a container filling operation and with the measuring piston in its uppermost position at the beginning of a nozzle charging operation.

In the drawings the numeral 1 generally designates a measuring cylinder and its associated structure and the numeral 2 generally designates the nozzle and associated structure formed according to this invention. The container to be filled is designated at C. The measuring apparatus 1 and the nozzle structure 2 are mounted on and supported by a suitable base plate 3 to which a plurality of vertically disposed posts 4 and 5 are secured and at the upper ends of which a cover plate 6 is secured. Only two vertical posts 4 and 5 are shown in FIGS. 2A and 2B. It will be understood that a corner post is provided at each corner of the generally rectangular base 3 and of cover 6, the front corner posts being omitted for clarity. Base 3 defines the upper boundary of a sterile environment therebelow.

Generally speaking material to be dispensed into container C is supplied from a gas tight temperature controlled sterile reservoir R through an inlet conduit 7 into the measuring cylinder 1 as the measuring piston moves upwardly and thence through conduit 8 to nozzle structure 2 from which the flowable material is discharged into container C.

Upward charging motion of the measuring piston 9 and downward discharging motion of piston 9 within measuring cylinder 10 is imparted by vertically reciprocable operating rods 11 which are driven by suitable crank means which is not shown in the drawings. Operating rods 11 are connected by means of pin 14 to arm 12 which is oscillatable about fixed pivot 13 as is obvious from FIGS. 2A and 2B. Set screw 15 is used to adjust the effective length of arm 12 for purposes of adjusting the amount of fill. Turnbuckle structure 16 is provided with threaded portion 17 and is interconnected with vertically reciprocable arms 18 by pin 19. The vertically reciprocable elements 18 shown in FIGS. 2A and 2B are provided with a cross pin 20 which is inserted through the opening 21 in the connecting block 22 threaded securely at 23 to the piston rod 24 which is secured at its lower end to the measuring piston 9 as is obvious from FIG. 3. As operating rods 11 reciprocate up and down as shown in FIGS. 2A and 2B, the arm 12 swings about its fixed center 13 and vertically reciprocates turnbuckle 16, 17, rod 18, and cross pin 20 and in turn the piston block 22, the piston rod 24, and piston 9.

Figure 3:
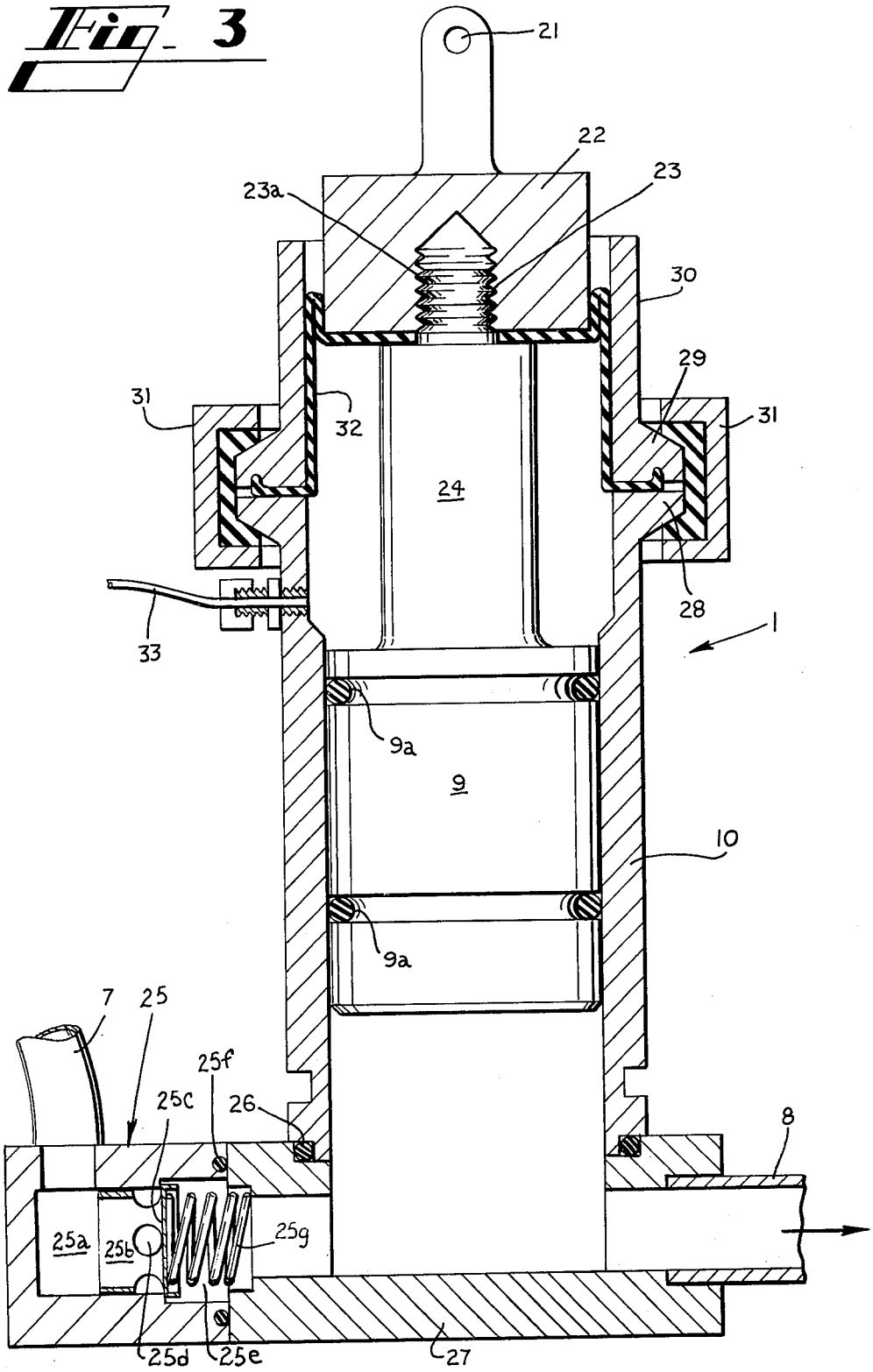
FIG. 3 is a cross-sectional view of the measuring cylinder and piston which are shown in FIGS. 2A and 2B.

As is best shown in FIG. 3, a check valve V having a housing 25 is connected with conduit 7 and includes a cavity **25*a* in which a cylinder 25*b* is slidable. Cylinder 25*b* is closed at its right hand end as indicated at 25*c* and includes a plurality of apertures 25*d*. A compression spring 25*g* biases the cylinder 25*b* toward the left as viewed in FIG. 3. This check valve is arranged to allow flow from left to right and to be sealed against flow in the opposite direction. Thus as piston 9 moves upwardly, flowable material to be dispensed into container C is drawn inwardly through conduit 7 into cavity 25*a* and causes cylinder 25*b* to move to the right against the force exerted by spring 25*g*. This establishes communication from cavity 25*a* through ports 25*d* with cavity 25*e* and the lower portion of measuring cylinder 10 so that when piston 9 occupies its uppermost position the portion of cylinder 10 disposed below piston 9 is filled with material to be dispensed into container C. Housing 25 is secured in fluid tight fashion by an O-ring 25*f* to base structure 27**.

As is apparent from FIG. 3 measuring cylinder 10 is secured in fluid tight fashion by sealing means such as O-ring 26 to the base structure 27 and piston rings **9*a* provide a sliding seal between measuring piston 9 and measuring cylinder 10**.

The upper end of measuring cylinder 10 is provided with a flange 28 which cooperates with the flange portion 29 of tube 30 which is clamped in place by a two part clamping device 31 which is of conventional construction.

For the purpose of providing means for isolating the interior of measuring cylinder 10 from atmosphere, a rolling seal is provided and comprises a diaphragm membrane 32 having a central aperture through which the threaded stud 23 projects. From FIG. 3 it is apparent that the inner portions of membrane 32 are clamped between piston rod 24 and piston block 22 which is screwed down via the threads **23*a* into firm contact with the upper end of piston rod 24. The outer edge of membrane 32 is clamped between flanges 29 and 28 in fluid tight relation. In order further to insure that the interior of measuring cylinder 10 is free of contamination from ambient atmosphere, the interior of the upper portion of measuring cylinder 10 above measuring piston 9 and below the rolling seal 32 is supplied with a sterile inert gas such as sterile nitrogen through the inlet conduit 33. Pressure of this gas above piston 9 and below the rolling seal 32 is maintained at a level somewhat above atmosphere so as to preclude the entry of contaminating material from ambient atmosphere into the interior of measuring cylinder 10 above piston 9**.

The stroke of measuring piston 9 and the quantity of flowable material drawn into the measuring cylinder 10 is determined by the length adjustment of pivot arm 12 via its threaded portions 15 so that the greater the upward travel of piston 9 the greater the quantity of material drawn into the measuring cylinder 10 through conduit 7 and check valve 25 as is obvious. Downward motion of measuring piston 9 forces the flowable material disposed therebelow outwardly through conduit 8 and its associated conduit 34 which is interconnected by clamping couple 35 with conduit 8 and which is arranged to discharge material to be dispensed into the nozzle structure 2.

As is apparent in FIGS. 2A and 2B downward movement of operating rods 11 and associated structure including cross pin 20 is accompanied by upward movement of connecting rods 36 and the nozzle structure interconnected therewith through pin 37 due to the fact that operating arm 38 is pivoted at 39 to fixed support means 40 and is arranged with its left hand portion 41 underneath the cross pin 29 and with its right hand end rotatably pinned at 42 to vertically disposed operating rods 36. While a downward movement of cross pin 20 and of measuring piston 9 is accompanied by positive mechanically coupled upward movement of operating rods 36, pivot 37, and of the nozzle structure associated therewith, it is apparent that downward movement of operating rods 36 and of the nozzle may occur which is free of the cross pin 20 and which is accompanied by clockwise rotation of operating arm 38 about pivot 39.

Figures 4, 4A:
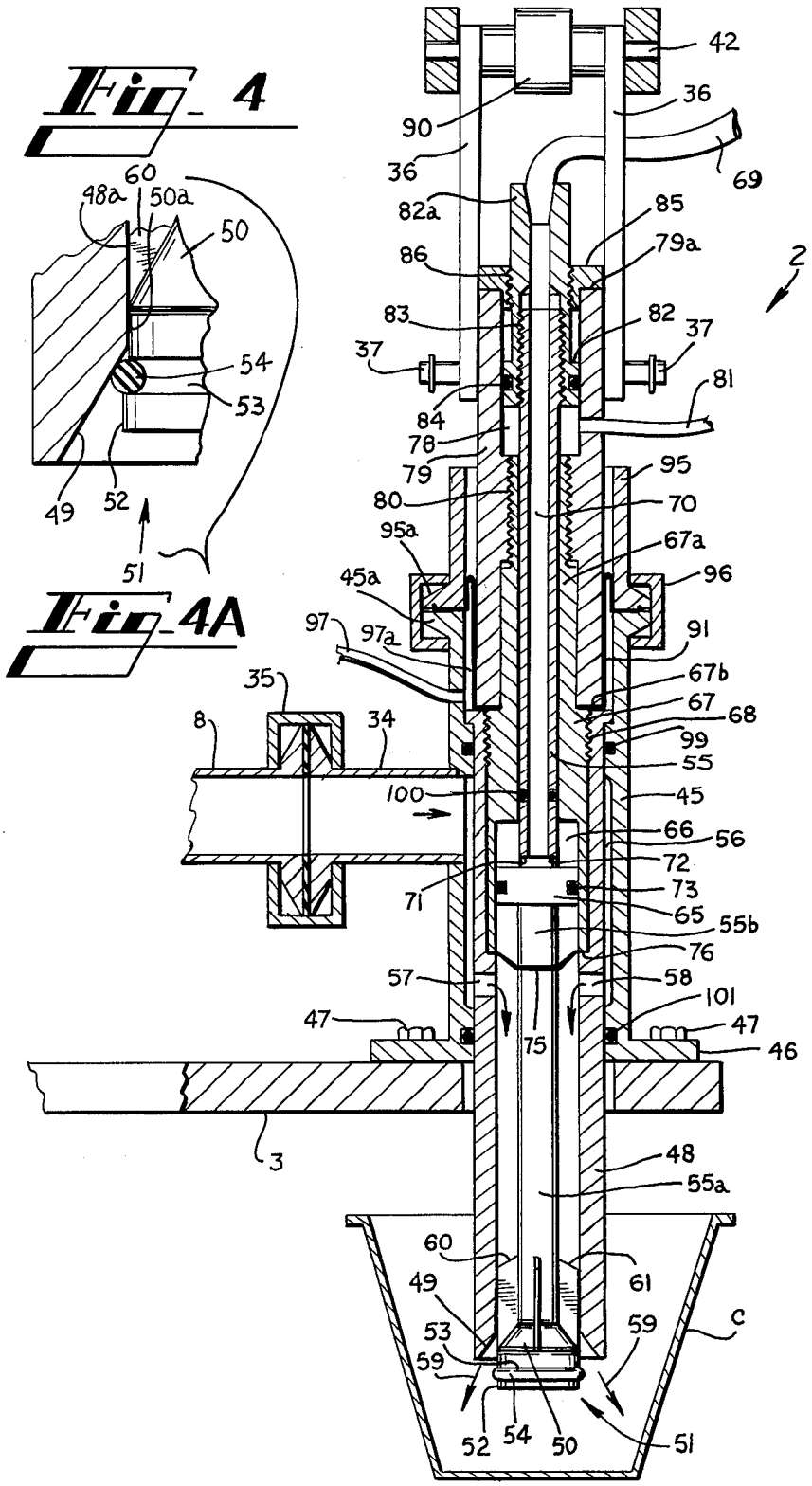
FIG. 4 is a cross-sectional view of the nozzle and its closure element and operating means.
FIG. 4A is an enlarged view of a fragmentary portion of FIG. 4.

Nozzle structure 2 is shown in cross section in FIG. 4 in a discharging condition during which upward movement of the nozzle takes place in order to prevent splashing of the material dispensed into the container C. The lost motion relationship between the left hand end of operating arm 38 and cross pin 20 permits upward movement of the nozzle structure 2 which is independent of but coupled with the movement of measuring piston 9 as is apparent from FIGS. 2A and 2B.

As is apparent from FIG. 4, housing structure 45 is provided with a lower flange 46 which is secured by bolts 47 to base 3. Housing 45 thus is fixed in position while the nozzle structure is slidable vertically inside housing structure 45.

In order to provide for various seals and to provide mechanism for operating the closure element of the nozzle, the structure generally described as nozzle structure is a composite assembly made up of a number of parts. For example lower nozzle element 48 is provided with an outwardly bevelled outlet indicated at 49 and a cone shaped upper portion 50 of closure element generally designated at 51. A peripheral groove 53 is formed in a cylindrical lower portion 52 of the closure element 51 and a yieldable sealing element such as an O-ring 54 is mounted in groove 53 and during closed condition engages the outwardly bevelled inner surface 49 of the hollow tube 48. When the valve is closed the O-ring is compressed somewhat which creates capillary action so that any drop is retained in the annular cavity. Closure element 51 is secured to vertically reciprocable rod 55 so that when the closure element is in its down position as represented in FIG. 4 material may be dispensed into container C. When the closure element 51 is in its up position with the O-ring 54 in engagement with the lower portion of the bevelled surface 49 the lower end of the nozzle is closed in a leak proof fashion because of the engagement of the O-ring with the lower portion of the bevelled surface 49 which provides an annular cavity immediately below the O-ring for accumulation of any excess flowable material by capillary action thereby to prevent dripping. Surface 50*a* slidably engages surface 48*a* to shear any solid pulp or other material which might tend to foster dripping of liquid or to cause opening of the valve.

Flowable material fed into conduit 34 enters transfer cavity 56 formed about the portion 48 of the nozzle and defined by the somewhat enlarged inner surface of housing 45. Apertures 57 and 58 are provided in the nozzle tube 48 and allow the passage of flowable material from the transfer cavity 56 to the inside of tube 48 and about the operating rod 55. When the valve is open this material flows into container C in the direction indicated by the arrows 59. Ribs 60 and 61 are formed along the upper surface of the cone shaped portion 50 so as not to form an umbrella as the material flows outwardly in the direction of the arrows 59. Such an umbrella causes the capture of gas which could agitate and possibly splash the flowable material.

At the beginning of a filling operation, the nozzle tube 81 occupies its lowermost position and the closure element 51 is open as shown in FIG. 4. As the filling operation begins, nozzle tube 48 is elevated while the closure element 51 remains open. Pressure fluid disposed above the piston of the fluid motor 63 drives the nozzle tube 48 and the closure element 51 downwardly in unison. Elevating motion is imparted to the nozzle 48 by the down stroke of the piston 9 and of rods 18, cross pin 20 and element 38.

Since the closure element 51 and its operating rod 55 are movable independently relative to nozzle tube 48, any suitable actuating means may be provided for effecting such motion. Valve opening motion is effected by valve opening piston 65 which is secured to the rod 55 and which is vertically slidable within valve opening cavity 66 formed within tube 67 which is threadedly secured at 68 within the upper portion of nozzle tube 48. Pressure fluid for valve opening piston 65 is introduced into opening cavity 66 through a conduit 69 and the hollow interior portion 70 of valve rod 55 through ports 71 and 72 to the upper working face of piston 65. O-ring 73 facilitates the seal between the periphery of valve opening piston 65 and the interior surface of valve opening cavity 66.

For the purpose of isolating the valve opening cavity 66 from the transfer cavity 56 and the interior of the lower portion of nozzle tube 48, a flexible diaphragm having a central aperture 75 is provided with a central opening clamped between lower part 55*a* of rod 55 and upper part 55*b* of rod 55 while the outer periphery of flexible seal or membrane 75 is securely gripped between the shoulder 76 of tube 48 and the lower end of tube 67 due to the threaded relationship as indicated at 68 whereby tube 67 is screwed firmly into contact with the periphery of membrane 75.

In order to impart upward closing movement to closure element 51 relative to nozzle 48, a valve closing cavity 78 is formed within tubular element 79 which is threaded at 80 to the outer upwardly extending portion of tube 67 and fluid pressure is supplied to valve closing cavity 78 through conduit 81. Valve closing piston 82 is threadedly related as indicated at 83 with the upwardly extending outer hollow portion of the valve rod 55 and is provided with a piston ring such as an O-ring 84 so that pressure fluid supplied through conduit 81 to valve closing cavity 78 effects upward movement of valve closing piston 82 and of the rod 55 which in turn effects closing of the closure element 51.

For the purpose of determining the lowermost position of the closure element 51, an adjustable stop 85 is threaded as indicated at 86 with the exterior surface of the upper part 82*a* of piston 82. Thus with adjustable stop 85 screwed upwardly relative to the upper end 82*a* of piston 82, the valve closure element 51 may move downwardly a greater distance than such element can move if the stop element 85 is lowered or screwed downwardly relative to part 82*a* so as to engage the upper end 79*a* of tube 79 and thus to allow a lesser degree of downward opening movement of valve closure element 51.

Due to the relationship between the stop 85 and the upper end 79*a* of tube 79, it is apparent that predetermined upward motion of the nozzle structure 48 necessarily is accompanied by upward motion of the valve rod 55 and of the closure element 51. This upward motion of the nozzle structure 2 due to the action of piston 9 which in its downward travel causes cross pin 20 to engage arm 38 which in turn moves counterclockwise about pivot 39 to raise pin 42 and the nozzle 48 and associated parts.

For the purpose of isolating the transfer cavity 56 from atmosphere, a rolling seal 91 having a central aperture disposed about the upper end 67*a* of tube 67 is arranged so that the inner periphery of this rolling seal 91 is clamped between the shoulder 67*b* of tube 67 and the lower end of tube 79, such clamping action being effected by the threads 80 as is obvious from FIG, 4. The outer edge portion of the rolling seal 91 is clamped between flange 45*a* of tube 45 and flange 95*a* of tube 95 by a conventional two-part clamp device 96. Thus by means of the rolling seal 91 movement of the nozzle tube 48 and parts associated therewith relative to the housing 45 may be effected without contamination from the atmosphere above the rolling seal 91, pressure being maintained within the housing 45 and below the rolling seal 91 by sterile inert gas supplied through tube 97 to the interior of housing 45. This pressure is maintained at a level slightly above atmosphere so as to preclude any possibility of contamination from atmosphere. O-rings 99, 100, and 101 are provided to effect sliding seals of telescoping elements.

Rolling seal 91 and diaphragm 75 serve to isolate the transfer cavity from atmosphere.

For the purpose of properly coordinating opening and closing of closure element 51 relative to nozzle 48 and for effecting lowering movement of the nozzle 48, suitable control mechanism is provided and may include solenoid actuated pneumatic valves. If desired such pneumatic valves may be mechanically actuated.

In order to effect opening movement of the closure element 51 by pressure fluid supplied to conduit 69, an operating rod 102 shown in FIGS. 2A and 2B is pinned at 103 with operating arm 38 and thus is reciprocated vertically through an opening formed in top cover plate 6 so as to come into engagement with a switch element schematically represented at 104 and mounted on suitable support structure 105 disposed atop the cover plate 6. Thus as the operating elements 11 move upwardly, nozzle structure 48 and its operating arm 36 move downwardly and operating arm 38 is rotated in a clockwise direction about the pivot 39 to cause upward movement of operating rod 102. When the nozzle 48 and its operating rods 36 reach their lowermost position, the upper end 102*a* of operating rod 102 engages the switch mechanism 104 and thus opens the valve supplying pressure fluid through conduit 69. As already explained, this action results in pressure being supplied to valve opening cavity 66 and the resulting downward movement of rod 55 and of closure element 51 relative to nozzle 48.

With the closure element 51 in the open position flow of material into container C is initiated while the nozzle 48 is in its lowermost position. Upward movement accompanied by filling of container C results when operating rods 11 move downwardly causing the cross pin 20 to move downwardly thereby to swing the operating arm 38 in a counterclockwise direction about fixed pivot 39 which in turn moves the nozzle 48 upwardly. This downward movement of cross pin 20 and of rods 18 causes operator element 107 to move downwardly into engagement with switch actuating element 108. Operation of this element occurs as the operating rods 18 and the measuring piston 9 arrive at their lowermost positions and as the nozzle 48 and parts associated therewith arrive at their uppermost position. Actuation of device 108 actuates an electric solenoid or other suitable device such as a pneumatic valve so as to allow pressure fluid to enter through the conduit 81 into the valve closing cavity 78 so that pressure on the lower surface of piston 82 imparts upward valve closing movement to valve rod 55 and to closure element 51 relative to nozzle tube 48 so that this element closes the outlet end of the nozzle as the nozzle reaches its uppermost position.

Following the completion of upward movement of nozzle tube 48 and downward movement of operating rods 11 and measuring piston 9, operating elements 11 begin their upward travel accompanied by downward movement of nozzle element 48 and parts associated therewith. When the operating rods 18 arrive at their uppermost positions the operating element 107 engages the switch operator 110 which in turn by solenoid or pneumatic means admits fluid pressure to the upper portion of the cylinder comprising a part of fluid motor 63. Such pressure drives the operating arms 36, the pivot 37, and the nozzle tube 48 and parts associated therewith toward their down positions. When the down position is reached, measuring piston 9 is in its uppermost position following which operating arms 11, 18, and cross pin 20 begin their downward movement which in turn by the mechanical interlock through bar 38 and pivot 42 initiates upward movement of nozzle 48 and the cycle is repeated.

The apparatus is self draining since liquid material in cylinder 10 may flow through conduit 8, transfer cavity 56, parts 57 and 58 and outwardly through tube 48 when the closure element 51 is open.

Thus with the apparatus in assembled condition the device may be sterilized with steam, hot water or other aqueous liquid sterilant.

There are no flexible hoses and their attendant connections for the flow of flowable material such as orange juice so that accumulations of microorganisms are eliminated.

The fact that the flow of flowable material is by positive displacement insures that the quantity of material supplied to container C can be maintained constant and may then be supplied to many containers with minimum variation in amount supplied.

INDUSTRIAL APPLICABILITY

It is apparent from the above description that this invention is primarily intended for use in filling containers such as plastic, paperboard, glass, metal or other containers with flowable material such as orange juice, apple juice, and the like and that the invention is particularly adapted to insure aseptic conditions for packaging a product due to the concept of isolation of product areas from actuating means by the sealing arrangement 91 and 75 and in part to the isolation of the open container and its contents from ambient atmosphere and also due to the fact that during filling, spraying, splashing and dripping following closure of the nozzle by the valve closure means are prevented so that a proper seal can be achieved between the open upper end of the container and its lid.

The embodiments of the invention in which an exclusive property or privilege is claimed are defined as follows:

1. Apparatus for aseptically filling a container (C) disposed within a sterile walled enclosure structure (3) pressurized with a sterile inert gas, said apparatus comprising a nozzle (48) movably mounted in an aperture formed in a wall of said enclosing structure and located above said container, a housing (45) secured to said wall in fluid tight relation and disposed about said nozzle, a rolling seal (91) secured in fluid tight relation to the interior of said housing and to the exterior of said nozzle and forming a fluid tight cavity therebetween, means

(97) for supplying inert sterile gas under pressure somewhat above atmospheric pressure to said cavity, and aseptic means (56-58) for supplying sterile flowable material to the interior of said nozzle.

2. Apparatus according to claim 1 wherein said aseptic means comprises a transfer cavity (56) within said housing and disposed about said nozzle and isolated from atmosphere by said rolling seal (91), and at least one aperture (57) in said nozzle and forming a passage between said transfer cavity and the interior of said nozzle.

3. Apparatus according to claim 1 wherein an operating rod (55*a*) reciprocably mounted in said nozzle and a closure element (51) is mounted on said rod and arranged to open and close the lower end of said nozzle and wherein a flexible fluid tight seal (75) is secured about said rod and to the inner surface of said nozzle.

4. Apparatus according to claim 1 wherein said aseptic means includes a measuring cylinder (10) in fluid tight communication with the interior of said nozzle (48), a measuring piston (9) movable in said measuring cylinder, a rolling seal (32) forming a fluid tight seal between said measuring cylinder and piston and isolating the interior of said measuring cylinder from atmosphere, and means (33) for supplying sterile inert gas under pressure to said interior of said measuring cylinder.

5. Apparatus according to claim 4 wherein said measuring cylinder (10) is in fluid tight communicaion with an aseptic reservoir (R) of flowable material through a check valve (V) arranged to accommodate date flow of material into said measuring cylinder.

6. An aseptic container filler comprising a vertically disposed tubular nozzle (48) having an outlet at its lower end and at least one aperture in its side wall, fixed housing structure (45) through which said nozzle is slidable and which is disposed about said nozzle and which defines a transfer cavity (56) arranged to receive and to supply through said aperture to the interior of said nozzle a fluid for filling a container (C) through said outlet, said fixed housing structure having means for isolating from the atmosphere the interior of said fixed housing structure valve means including a valve rod (55*a*) and a closure element (51) on said valve rod and disposed within said nozzle for controlling said outlet, and means for opening (65) and closing (82) said valve means.

7. A container filler according to claim 6 wherein a valve closing cavity (78) is formed within said nozzle and wherein a valve closing piston (82) is mounted on said valve rod and reciprocable within said valve closing cavity and wherein means (81) are provided for supplying pressure fluid to said valve closing cavity thereby to close said closure element.

8. A container filler according to claim 6 wherein a valve opening cavity (66) is formed within said nozzle and wherein a valve opening piston (65) is mounted on said valve rod and reciprocable within said valve opening cavity and wherein means 69 are provided for supplying pressure fluid to said valve opening cavity thereby to open said closure element.

9. A container filler comprising a vertically disposed tubular nozzle (48) having an outlet at its lower end and at least one aperture in its wall, housing structure (45) through which said nozzle is slidable and which is disposed about said nozzle and defining a transfer cavity (56) arranged to receive and to supply through said aperture to the interior of said nozzle a fluid for filling a container (C) through said outlet, valve means including a valve rod (55*a*) and a closure element (51) on said valve rod and disposed within said nozzle for controlling said outlet, means for opening (65) and closing (82) said valve means, and a rolling seal (91) having an inner aperture secured about its outer edges with said housing structure and about its inner aperture with an outer surface of said nozzle thereby to establish an aseptic seal therebetween.

10. A container filler according to claim 9 wherein said rolling seal (91) is arranged to isolate said transfer cavity from atmosphere.

11. A container filler according to claim 10 wherein a resilient seal (99) is arranged to form a seal between said housing structure (45) and the exterior of said nozzle (48) and is disposed between said transfer cavity (56) and said rolling seal to form a barrier cavity (97*a*) therebetween.

12. A container filler according to claim 11 wherein a measuring cylinder (10) and piston (9) are in communication with said nozzle and arranged to force a predetermined quantity of flowable substance into said nozzle during elevating movement thereof and while said valve means is open.

13. A container filler according to claim 12 wherein said measuring cylinder (10) is fixed in position and said measuring piston (9) is directly coupled with said nozzle by positively acting coupling means (38) during elevating movement of said nozzle.

14. A container filler according to claim 12 wherein said measuring cylinder (10) is fixed and said measuring piston (9) is coupled with said nozzle by a lost motion coupling means (20, 38) during filling of said flowable substance into said measuring cylinder.

15. A container filler according to claim 14 wherein said nozzle (48) is lowered by operating means (63) which is independent of said measuring piston at least during an initial portion of a nozzle lowering operation.

16. A container filler according to claim 12 wherein a rolling seal (32) having a central aperture is arranged with its outer edge secured to an extension of said measuring cylinder and with its central aperture secured to an extension of said measuring piston so as to form a seal therebetween whereby said measuring piston and cylinder are isolated from ambient atmosphere.

17. A filler according to claim 16 wherein said closure element includes a cone shaped part (50) about said cylindrical part and wherein at least one rib (60,61) is formed on said cone shaped part.

18. A container filler according to claim 12 wherein the stroke of said piston is adjustable to vary the quantity of material into said nozzle.

19. A container filler comprising a vertically disposed tubular nozzle (48) having an outlet at its lower end, housing structure (45) through which said nozzle is slidably movable and which is disposed about said nozzle and which defines a transfer cavity (56) arranged to receive and to supply to the interior of said nozzle a fluid for filling a container (C) through said outlet, valve means including a valve rod (55*a*) and a closure element (51) on said valve rod and disposed within said nozzle for controlling said outlet, means for opening (65) and closing (82) said valve means, a rolling seal (91) having an inner aperture and secured about its outer edge with said housing structure and about its inner aperture with an outer surface of said nozzle thereby to establish an aseptic seal therebetween and to isolate said cavity from atmosphere, a resilient seal (99) arranged to form a seal between said housing structure (45) and the exterior of said nozzle (48) and disposed between said transfer cavity (56) and said rolling seal to form a barrier cavity (97*a*) therebetween, said barrier cavity (97*a*) being filled with a sterile inert gas at a pressure in excess of atmospheric pressure.

20. A container filler comprising a vertically disposed tubular nozzle (48) having an outlet at its lower end, housing structure (45) through which said nozzle is slidably movable and which is disposed about said nozzle and which defines a transfer cavity (56) arranged to receive and to supply to the interior of said nozzle a fluid for filling a container (C) through said outlet, valve means including a valve rod (55*a*) and a closure element (51) on said valve rod and disposed within said nozzle for controlling said outlet, means for opening (65) and closing (82) said valve means, a rolling seal (91) having an inner aperture and secured about its outer edge with said housing structure and about its inner aperture with an outer surface of said nozzle thereby to establish as aseptic seal therebetween and to isolate said cavity from atmosphere, a resilient seal (99) arranged to form a seal between said housing structure (45) and the exterior of said nozzle (48) and disposed between said transfer cavity (56) and said rolling seal to form a barrier cavity (97*a* ) therebetween, a measuring cyclinder (10) and piston (9) in communication with said nozzle and arranged to force a predetermined quantity of flowable substance into said nozzle during elevating movement thereof and while said valve means is open, and means (33) for filling the space between said rolling seal (32) and said piston (9) with a sterile inert gas at a pressure somewhat above atmospheric pressure thereby to preclude the entry of atmospheric air into said measuring cylinder.

21. A container filler comprising a vertically disposed tubular nozzle (48) having an outlet at its lower end and at least one aperture in its wall, housing structure (45) through which said nozzle is slidable and which is disposed about said nozzle and defining a transfer cavity (56) arranged to receive and to supply through said aperture to the interior of said nozzle a fluid for filling a container (C) through said outlet, valve means including a valve rod (55*a*) and a closure element (51) on said valve rod and disposed within said nozzle for controlling said outlet, means for opening (65) and closing (82) said valve means, and a diaphram (75) having an inner aperture secured about its outer periphery to an inner surface of said nozzle (48) and about its inner aperture with an outer surface of said valve rod (55*a*) so as to establish an aseptic seal therebetween.

22. A container filler comprising a vertically disposed tubular nozzle (48) having an outlet at its lower end and at least one aperture in its wall, housing structure (45) through which said nozzle is slidable and which is disposed about said nozzle and defining a transfer cavity (56) arranged to receive and to supply through said aperture to the interior of said nozzle a fluid for filling a container (C) through said outlet, valve means including a valve rod (55*a*) and a closure element (51) on said valve rod and disposed within said nozzle for controlling said outlet, means for opening (65) and closing (82) said valve means, a valve opening cavity (66) formed within said nozzle, a valve opening piston (65) mounted on said valve rod and reciprocable within said valve opening cavity, and means (69) supplying pressure fluid to said valve opening cavity thereby to open said closure element, said means for supplying pressure fluid to said valve opening cavity including a hollow portion (70) of said valve rod at a position thereof remote from said closure element (51) and at least one port (71) adjacent said piston (65) for establishing communication between said hollow portion (70) of said valve rod and said valve opening cavity (66).

23. A container filler according to claim 22 wherein a stop member (85) is adjustably mounted on said valve rod (55) and engageable with a part (79*a*) of said nozzle to determine the maximum limit of opening travel of said valve rod and of said closure element.

* * * * *